US006623561B2

(12) United States Patent
Vetter et al.

(10) Patent No.: US 6,623,561 B2
(45) Date of Patent: Sep. 23, 2003

(54) ROTARY ATOMIZER FOR PARTICULATE PAINTS

(75) Inventors: Kurt Vetter, Rechbergweg (DE); Rolf Schneider, Bergstrabe (DE); Andreas Fischer, Mainzer Allee (DE); Robert F. Heldt, Oxford, MI (US)

(73) Assignee: Behr Systems, Inc., Auburn Hills, MI (US)

( * ) Notice: Subject to any disclaimer, the term of this patent is extended or adjusted under 35 U.S.C. 154(b) by 28 days.

(21) Appl. No.: 09/769,707

(22) Filed: Jan. 25, 2001

(65) Prior Publication Data

US 2001/0001946 A1 May 31, 2001

Related U.S. Application Data

(62) Division of application No. 09/271,477, filed on Mar. 17, 1999, now Pat. No. 6,189,804.
(60) Provisional application No. 60/079,565, filed on Mar. 27, 1998.

(51) Int. Cl.[7] ..... B05C 5/00; B05B 7/00
(52) U.S. Cl. ..... 118/314; 239/223; 239/224
(58) Field of Search ..... 118/314, 324, 118/315, 313, 309, 305; 239/751, 752, 223–224

(56) References Cited

U.S. PATENT DOCUMENTS 4,376,135 A 3/1983 Patel et al.
4,512,518 A * 4/1985 Inukai ..... 239/223
4,521,462 A 6/1985 Smythe
4,589,597 A 5/1986 Robisch et al.
4,684,064 A 8/1987 Kwok
4,919,333 A 4/1990 Weinstein
4,919,967 A * 4/1990 Handke et al. ..... 427/8
4,927,081 A 5/1990 Kwok et al.
4,985,283 A * 1/1991 Ogata et al. ..... 427/424
5,011,086 A 4/1991 Sonnleitner et al.
5,078,321 A 1/1992 Davis et al.
5,079,030 A * 1/1992 Tomioka et al. ..... 427/27
5,090,361 A * 2/1992 Ishibashi et al. ..... 118/313
5,397,063 A 3/1995 Weinstein
5,531,833 A * 7/1996 Ogasawara et al. ..... 118/314
5,620,750 A * 4/1997 Minoura et al. ..... 427/421
5,622,563 A 4/1997 Howe et al.
5,633,306 A 5/1997 Howe et al.
5,662,278 A 9/1997 Howe et al.
5,683,032 A 11/1997 Braslaw et al.
5,865,380 A 2/1999 Kazama et al.
5,947,377 A * 9/1999 Hansinger et al. ..... 239/3

* cited by examiner

*Primary Examiner*—Richard Crispino
*Assistant Examiner*—Yewebdar T Tadesse
(74) *Attorney, Agent, or Firm*—Howard & Howard

(57) ABSTRACT

A rotary atomizer applies particulate paints with good color matching by reducing paint droplet size deviation and then optimizing the other paint spraying parameters. Paint droplet size parameters are reduced by using a bell cup having reduced flow deviations, including an overflow surface having a generally constant angle between a deflector and an atomizing edge.

12 Claims, 4 Drawing Sheets

ROTARY ATOMIZER FOR PARTICULATE PAINTS

This application claims priority to U.S. provisional patent application Ser. No. 60/079,565, filed Mar. 27, 1998 and is a divisional U.S. application Ser. No. 09/271,477, filed Mar. 17, 1999, now U.S. Pat. No. 6,189,804.

BACKGROUND OF THE INVENTION

The present invention relates generally to rotary atomizers and more particularly to a rotary atomizer having improved performance for particulate paints.

Currently, many paints are applied by rotary atomizers to work pieces, such as automobile bodies. Rotary atomizers include a rotating bell cup having a generally conical overflow surface between a radially inward central axial opening and a radially outward atomizing edge. At or near the atomizing edge, the angle of the overflow surface relative to the axis of the bell cup decreases sharply to form a lip adjacent the atomizing edge. The purpose of this lip is to generally direct the atomized paint more axially forward and reduce radial scatter. The known atomizer bell cups further include a deflector, also of generally rotational symmetry, disposed in front of the central axial opening. Paint entering the bell cup through the central axial opening contacts the rear surface of the deflector and is disbursed radially outwardly towards the overflow surface.

In the known atomizer bell cups, the paint follows a tortuous, turbulent path from the nozzle to the atomizing edge. As a result, the paint flow to the atomizing edge is turbulent and fluctuates cyclically. As a result, paint from the atomizer is atomized to a wide variety of paint droplet sizes. The paint droplets can vary by up to 100 microns or more.

Current rotary atomizers are unable to obtain good color matching applying paints with particulates, such as mica. Generally, the mica comprise particles on the order of 3 microns by 200 microns. When this paint is applied by rotary atomizers, the mica particles are oriented generally perpendicular to the application surface. As a result, the paint has a different tint or color than intended, i.e. with the mica particles laying flat. In order to correct this problem, a second coat of the paint is typically applied with air atomized spray guns rather than rotary atomizers. This second coat provides the proper color; however, air atomized spray guns have a low transfer efficiency (approximately 50%) compared to rotary atomizers (approximately 80%). The air atomized spray guns therefore increase the amount of paint lost, increasing the cost of the paint process and cause environmental concerns regarding the disposal of the lost paint.

SUMMARY OF THE INVENTION

The present invention provides a rotary atomizer which provides improved color matching. Generally, the improved atomizer provides a more uniformed paint droplet size, which in turn facilitates control of the particulates in order to assure proper orientation of the particulates and obtain good color matching.

The rotary atomizer bell cup according to the present invention provides several inventive features directed toward reducing deviation in paint droplet size. First, the bell cup includes a generally conical overflow surface having a generally constant flow angle between a deflector and the atomizing edge. Further, the exposed surface area of the overflow surface is increased by decreasing the size of the deflector relative to previous bell cups in order to cause evaporation of solvent from the paint from the overflow surface. The diameter of the atomizing edge is also increased, thereby reducing the thickness of the paint film at the atomizing edge. The bell cup is designed to reduce flow deviations of the paint as it travels from the axial opening to the spray edge in order to provide laminar flow of the paint across the overflow surface and the atomizing edge.

The bell cup is made hollow in order to reduce the weight of the bell cup. A rear cover is secured to the rear of the bell cup body, enclosing an annular cavity.

BRIEF DESCRIPTION OF THE DRAWINGS

The above, as well as other advantages of the present invention, will become readily apparent to those skilled in the art from the following detailed description of a preferred embodiment when considered in the light of the accompanying scale drawings in which.

DETAILED DESCRIPTION OF PREFERRED EMBODIMENTS

Figure 1:
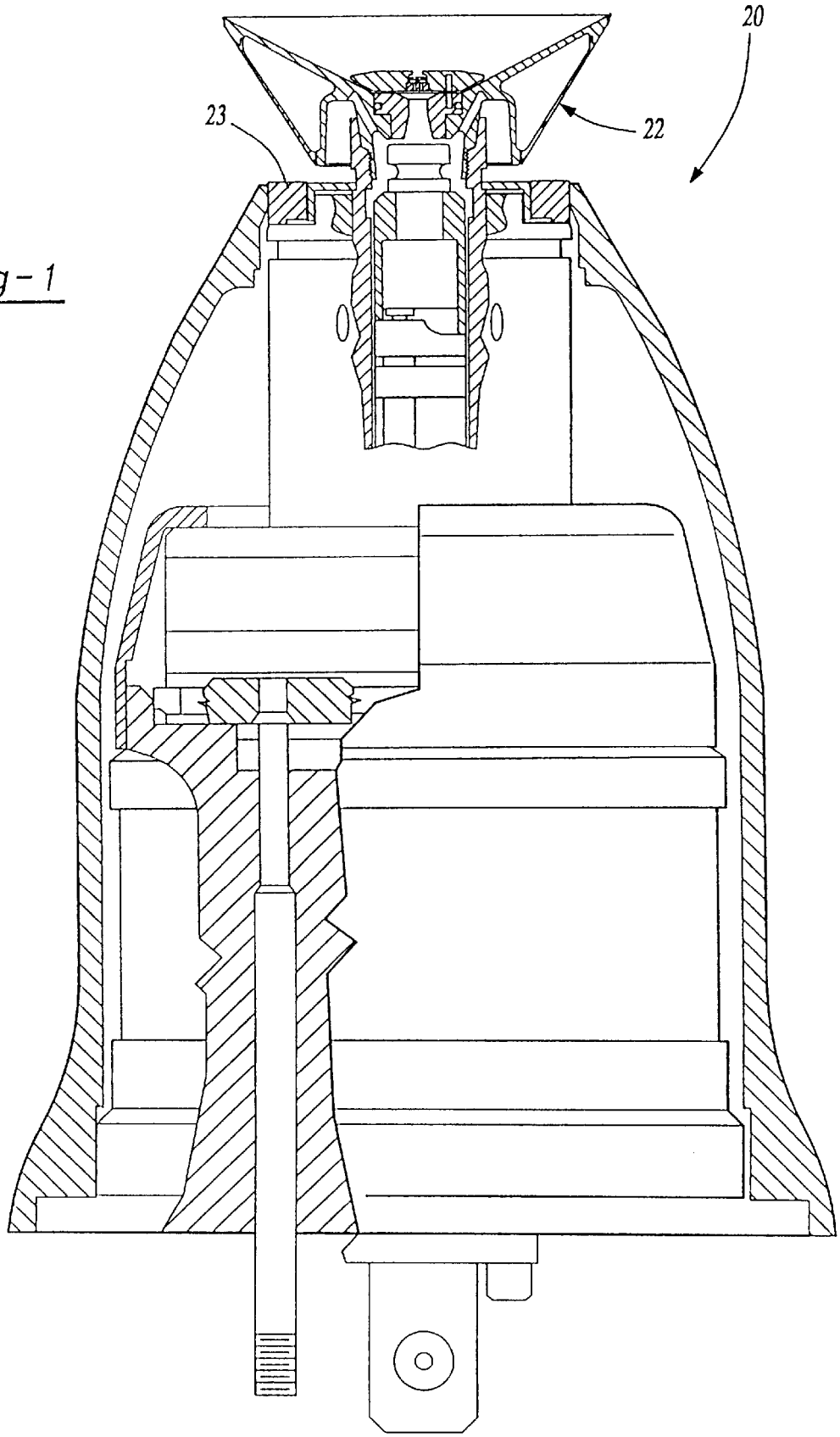
FIG. 1 is a scale drawing of the atomizer of the present invention.

FIG. 1 illustrates a rotary atomizer 20 and a bell cup 22 according to the present invention. The atomizer includes a shaping air ring 23 which preferably includes 30 nozzles generally parallel to the axis of the atomizer. The shaping air ring 23 supplies shaping air, preferably at 100 liters per minute. With the reduced number of holes from the known shaping air ring (typically 40), this produces increased turbulence by the shaping air.

Figure 2:
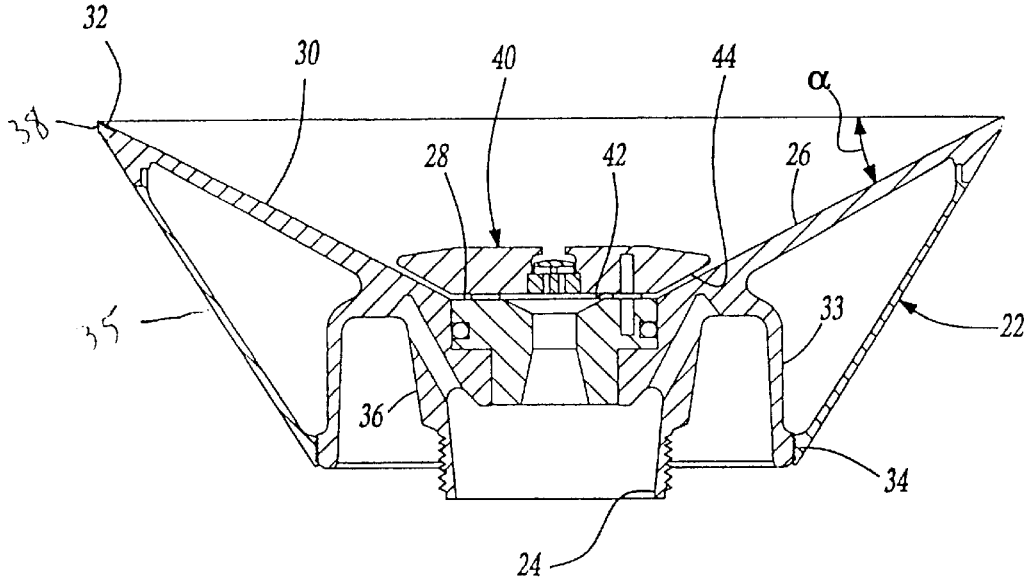
FIG. 2 is a scale drawing in cross section of the atomizer of FIG. 1.
Figure 3:
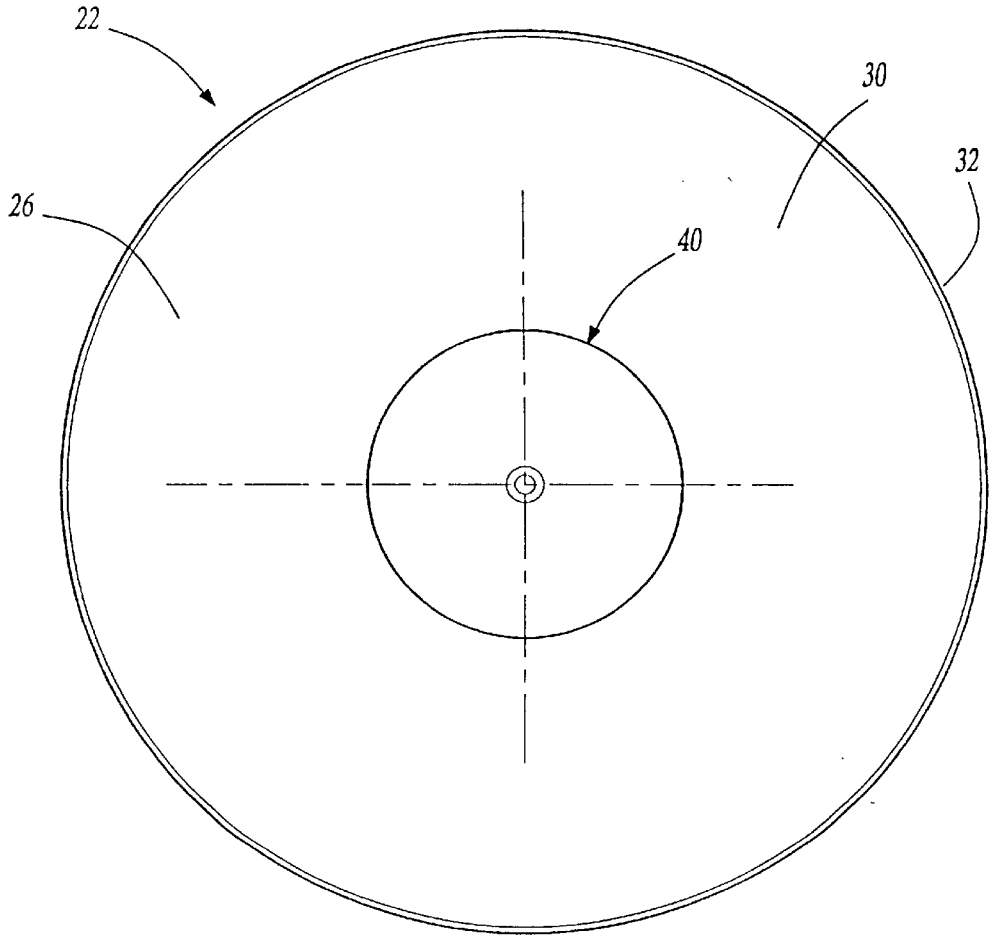
FIG. 3 is a scale drawing front view of the bell cup of FIG. 2.

The bell cup 22 is shown in more detail in FIGS. 2–3. Bell cup 22 includes a central axial opening 24 at the base of the bell cup 22. The central axial opening 24 includes a coaxial passageway onto a front surface 26 of the bell cup 22. The front surface 26 of the bell cup 22 includes a central flat portion 28 generally perpendicular to the axis of the bell cup 22 and a generally conical overflow surface 30 from the perpendicular portion 28 to a spray edge 32. Between the perpendicular surface 28 and the spray edge 32, the overflow surface 30 has a smooth continuous surface of a constant flow angle $\alpha$ relative to the annular spray edge 32, preferably 5–40 degrees, more preferably 26–30 degrees and most preferably 28.25 degrees The diameter of the annular spray edge 32 is preferably 63–75 mm, and most preferably 64.6 millimeters.

An annular hub 33 extends rearwardly from the bell cup 22 and includes an externally threaded portion 34. A frustoconical rear cover 35 is threaded onto the threaded portion 34 of the annular hub 33 and welded or glued to the rear of the bell cup 22 behind the spray edge 32. As a result, the body of the bell cup 22 behind the overflow surface 26 is hollow, reducing the weight of the bell cup 22. A concentric inner hub 36 extends rearwardly from the bell cup 22 and is externally threaded for mounting to the atomizer 20. Other means for attaching the bell cup 22 to the atomizer 20 can also be utilized. The spray edge 32 forms a sharp edge between the overflow surface 30 and a small bevel 38 leading to the outer rear surface of the bell cup 22.

If the atomizer 20 is to be used to apply basecoat, the bell cup 22 preferably comprises a titanium alloy, preferably Ti-6Al-4V. If the atomizer 20 is to be used to apply clear coat or primer, the bell cup 22 is preferably Aluminum, most preferably 6Al-4V, 6Al-25N-4Zr-2MO. If the bell cup 22 is titanium, the rear cover 35 is preferably welded to the rear of the bell cup 22 behind the spray edge 32. If Aluminum is used, the rear cover 35 is preferably glued to the rear of the bell cup 22 behind the spray edge 32. Small serrations may be formed on the surface 26 at the spray edge 32 for clearcoat spraying. These serrations are well known and utilized in the art.

Positioned in front of the central axial opening 24 is a deflector 40 which includes a rear surface 42 generally parallel to the perpendicular surface 28 of the bell cup 22 and a rear conical surface 44 which is preferably parallel to the overflow surface 30 of the bell cup 22. The deflector 40 is preferably approximately 22.3 millimeters in diameter, and preferably approximately ⅓ of the diameter of the spray edge 32. More particularly, the diameter of the deflector is less than 40 percent, and most preferably approximately 34.5 percent the diameter of the spray edge 32.

Figure 4:
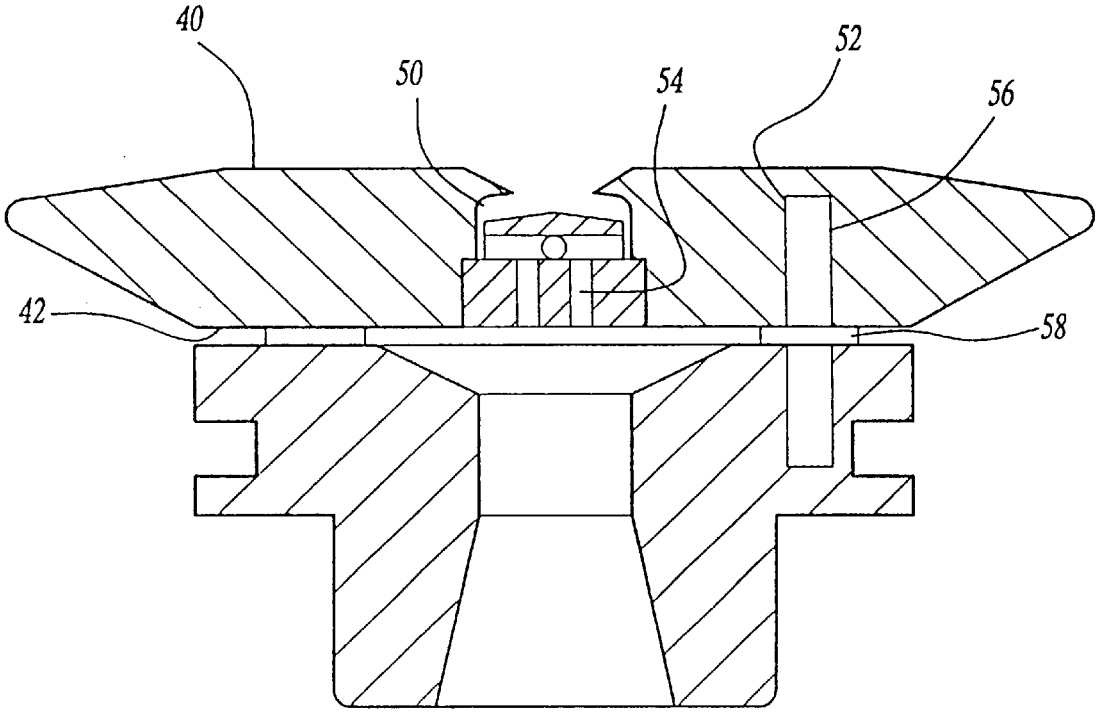
FIG. 4 is a scale enlarged view of the deflector of FIG. 2.

The deflector 40 is shown in more detail in FIG. 4. A passageway 50 leads from the rear surface 42 to a front surface 52 of the deflector 40 and includes four tubular passageways 54 (two shown) leading from the rear surface 42. The deflector 40 is retained on the bell cup 22 with a plurality, preferably 3, press fit, barbed connectors 56 having spacers 58 preferably 0.7 millimeters wide.

The improved bell cup 22 provides a reduced deviation in particle size, which in turn facilitates control of the particulates. In other words, if the size of the atomized paint particles from the spray edge 32 is known, the shaping air velocity, turbulence and RPM of the bell cup 22 and paint flow can be adjusted to ensure that the particles are forced to lay flat on the painted surface by the shaping air from the shaping air ring 23. With a reduced deviation in particle size, these parameters can be optimized for a greater percentage of the paint droplets, thereby providing better color matching.

The reduced deviation in particle size is a result of several inventive aspects of the bell cup 22 and deflector 40. First, the larger annular surface 30 causes more of the solvent (such as water) to evaporate before reaching the spray edge 32. The large diameter spray edge 32 provides a thin film of paint at the spray edge 32. The reduced ratio of the deflector disk 40 to the spray edge 32 provides a more constant, laminar flow across the overflow surface 30 to the spray edge 32. Because the conical surface 30 is continuous and smooth from the deflector 40 to the spray edge 32 and has a constant angle $\alpha$, the paint flow rate to the spray edge is constant (i.e. does not oscillate). As a result, better control over paint particle size is achieved. Further, as can be seen in FIG. 2, the bell cup 22 of the present invention provides only three flow deviations between the central axial opening 24 and spray edge 32, thus providing a constant, substantially laminar paint flow at the spray edge 32 and therefore a reduced deviation in particle size.

Figure 5:
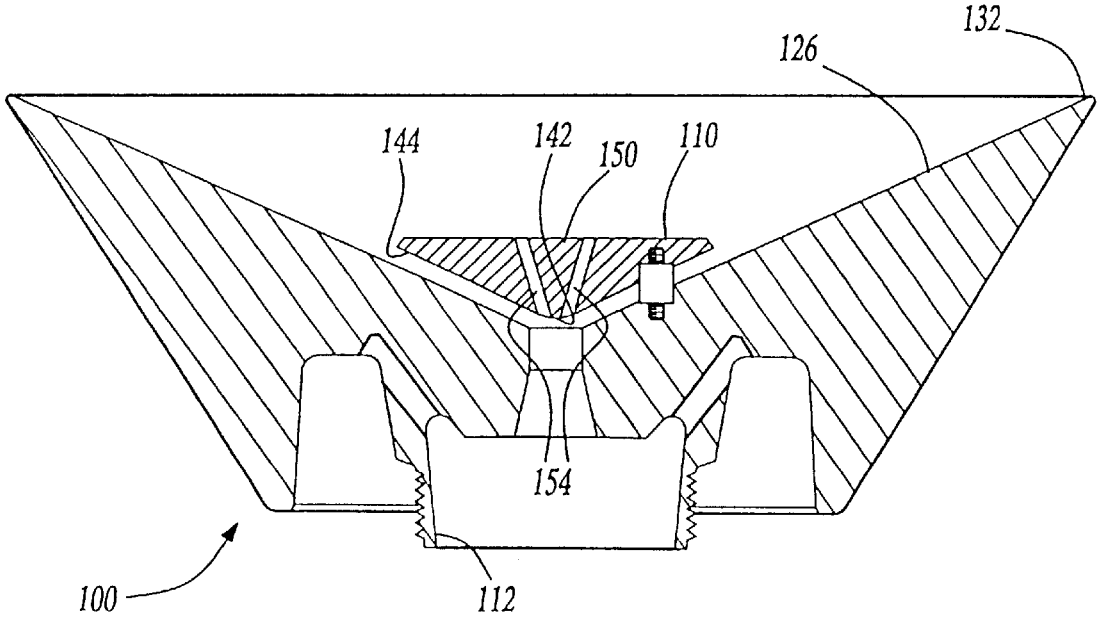
FIG. 5 is a scale cross-sectional view of an alternate bell cup.
Figure 6:
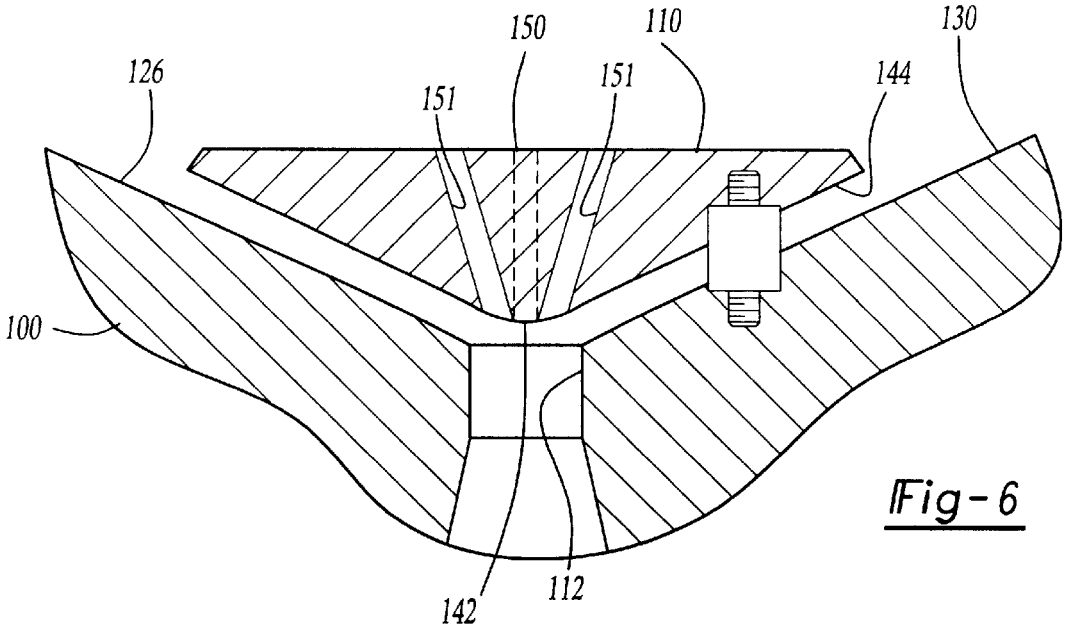
FIG. 6 is an enlarged scale view of the deflector in the bell cup of FIG. 5.
Figure 7:
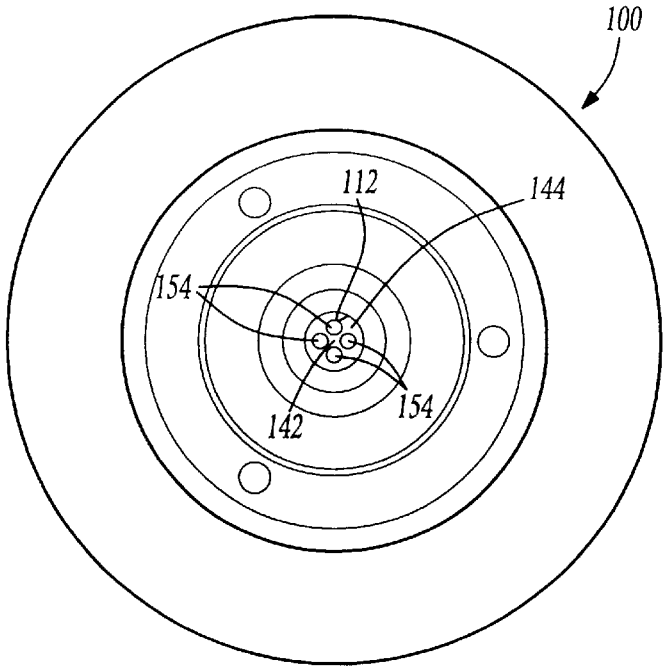
FIG. 7 is a scale bottom view of the bell cup of FIG. 5.

FIGS. 5 through 7 disclose an alternative embodiment of a bell cup 100 having a deflector 110. This bell cup 100 provides only two flow deviations between the central axial opening 112 and the spray edge 132. The conical portion 130 of the overflow surface extends directly from the central axial opening 112 to the spray edge 132. Thus, the overflow surface 126 does not include a perpendicular portion (like perpendicular portion 28 of FIG. 2). This further improves the laminar flow of the paint and reduces further the particle size deviation. The deflector 110 includes a generally conical rear surface 144 which extends to a generally rounded central rear surface 142, thus reducing the flow deviation for the paint. A passageway 150 leads through the deflector 110 and includes four diverging tubular passageways 151. Alternatively, the passageways 151 may converge. The bell cup 100 can also be mounted on atomizer 20 of FIG. 1 in place of bell cup 22.

FIGS. 1–7 are scale drawings.

Figure 8:
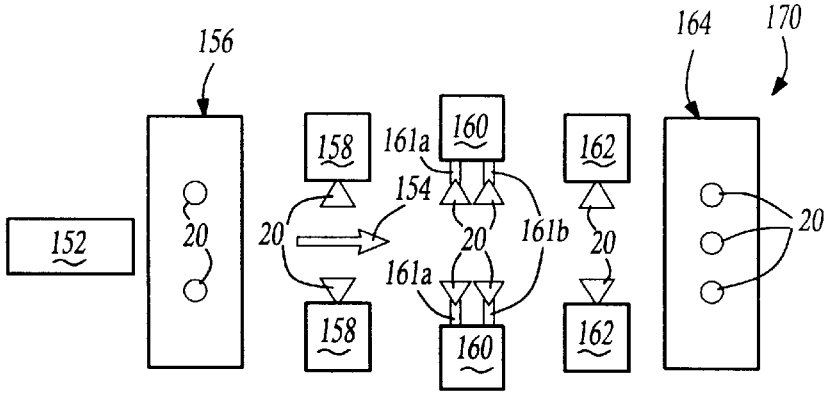
FIG. 8 illustrates one possible layout for applying a base coat with the atomizer of FIG. 1 and the bell cup of FIGS. 2 or 5.

FIG. 8 illustrates one potential layout of a paint spray zone 150 for applying a basecoat to a vehicle body 152 utilizing the atomizer 20 of the present invention shown in FIGS. 1–7. The vehicle body 152 travels in the direction 154 through the zone 150 while atomizers 20 apply basecoat paint. The zone 150 is a two-pass, thirteen-bell zone which would apply basecoat with good color matching with the efficiency of rotary atomizers. In known systems, the basecoat would be applied by nine rotary atomizers and six air atomizers. The length of the zone 150 could be reduced to approximately thirty feet, compared to forty-five feet for the known basecoat zones. In the zone 150, an overhead machine 156 includes two atomizers 20 and applies a first coat to the center of the horizontal surfaces. A pair of side machines 158 preferably each oscillate an atomizer 20 the full length of the doors of the vehicle 152 on the first pass. A pair of side machines 160 each include a pair of vertically and horizontally offset atomizers each mounted on arms 161. A first arm 161*a* provides three axes of motion to contour the pillars and paint the edge of the hood and trunk. The second arm 161*b* is fixed with pivot and horizontal capp. to process the rocker. A pair of side machines 162 provide a second pass on the doors of the vehicle 152. A second overhead machine 164 includes three atomizers 20 to provide a second pass on the horizontal surfaces.

An example will be given utilizing the inventive atomizer 20 of FIGS. 1–4 in the arrangement of FIG. 8 to spray BASF Prairie Tan Metallic Solvent based paint M6818A in a two-pass bell basecoat application with the following parameters: bell cup 22 rotation: 60,000 RPM; fluid flow: 200 cc/min on a first pass and 75 cc/min on a second pass; shaping air: 200L/min on the first pass and 50L/min on the second pass. Preferably, any resonant frequencies of the atomizer bearing are avoided. The atomizer 20 produces reduced droplet size deviation, typically 80% of the droplets will be within an 8–50 $\mu$m size deviation. With reduced size deviation, the other parameters can be adjusted to ensure that the mica particles lie flat, thereby providing good color matching. Most preferably, the particle size deviation is reduced below 30 $\mu$m. The atomizer 20 produces improved color matching over previous bell zones. The colorimetry data for the example is: $\Delta L<2.0$, $\Delta A<1.0$ and $\Delta B<1.0$. By providing good color matching with rotary atomizers rather than air atomizers, efficiency is greatly improved.

More generally, the bell speed rotation is preferably between 60,000 and 80,000 RPM. Also, the fluid flow of paint preferably does not exceed 250 ml/min.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A paint spray zone for applying a particulate paint including particulates and a solvent with rotary atomizers each having a bell cup including a substantially continuous conical overflow surface providing laminar flow, an annular spray edge surrounding said overflow surface, an inlet and a circular deflector opposite said inlet overlapping said overflow surface in spaced relation, wherein a diameter of said deflector is less than forty percent of said overflow surface at said annular spray edge causing evaporation of solvent, said rotary atomizers atomize the particulate paint droplets having a size deviation of less than 50 microns, comprising a first plurality of said rotary atomizers applying a first coat of the particular paint to a surface and a second plurality of said rotary atomizers applying a second coat of the particulate paint to said surface over said first coat.

2. The paint spray zone defined in claim 1, wherein said rotary atomizers atomize the particulate paint into paint droplets having a paint droplet size deviation of 30 microns or less.

3. The paint spray zone for applying a particulate paint as defined in claim 1, wherein said conical overflow surface of said bell cup of each of said rotary atomizers has a smooth constant continuous cone angle providing laminar flow of said particulate paint.

4. The paint spray zone for applying a particulate paint as defined in claim 3, wherein said cone angle of said overflow surface is between 26 and 30 degrees.

5. The paint spray zone for applying a particulate paint as defined in claim 1, wherein said annular spray edge has a diameter of between 63 and 75 mm.

6. The paint spray zone for applying a particulate paint as defined in claim 1, wherein said rotary atomizers apply said particulate paint to the surface and cause said particulates to lie flat on said surface.

7. A paint spray zone for applying a particulate paint including particulates and a solvent with rotary atomizers each having a bell cup including a smooth continuous conical overflow surface extending to a circular spray edge providing laminar flow over said smooth continuous conical overflow surface, a central particulate paint inlet and a central annular deflector opposite said inlet overlapping said overflow surface in spaced relation, wherein said rotary atomizers atomize the particulate paint into paint droplets having a paint droplet size deviation of less than 50 microns, said paint spray zone comprising a first plurality of said rotary atomizers applying a first coat of the particulate paint to a surface and a second plurality of said rotary atomizers applying a second coat of the particulate paint over said surface over said first coat.

8. The paint spray zone for applying a particulate paint as defined in claim 7, wherein said deflector has a diameter of less than forty percent of said overflow surface at said circular spray edge causing evaporation of said solvent.

9. The paint spray zone for applying a particulate paint as defined in claim 7, wherein said smooth continuous conical overflow surface of said bell cup has a cone angle of between 26 and 30 degrees.

10. The paint spray zone for applying a particulate paint as defined in claim 7, wherein said circular spray edge has a diameter of between 63 and 75 mm.

11. The paint spray zone for applying a particulate paint as defined in claim 7, wherein said rotary atomizers atomize the particulate paint into paint droplets having 80 percent within a 8 to 50 micron deviation.

12. The paint spray zone for applying a particulate paint as defined in claim 7, wherein said rotary atomizers atomize the particulate paint into paint droplets having a paint droplet size deviation of less than 30 microns.

* * * * *